US008237630B2

(12) United States Patent
Nam et al.

(10) Patent No.: US 8,237,630 B2
(45) Date of Patent: Aug. 7, 2012

(54) PLASMA DISPLAY, CONTROLLER AND DRIVING METHOD THEREOF WITH SIMULTANEOUS DRIVING WHEN MAXIMUM GRAYSCALE IS HIGHER THAN REFERENCE LEVEL

(75) Inventors: Hyun-Seok Nam, Suwon-si (KR); Kang-Hee Lee, Suwon-si (KR); Soo-Hyun Kim, Suwon-si (KR); Tae-Kyoung Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 1140 days.

(21) Appl. No.: 12/081,993

(22) Filed: Apr. 24, 2008

(65) Prior Publication Data

US 2008/0291133 A1 Nov. 27, 2008

(30) Foreign Application Priority Data

May 23, 2007 (KR) ..... 10-2007-0050436

(51) Int. Cl.
*G09G 3/28* (2006.01)

(52) U.S. Cl. ..... 345/63

(58) Field of Classification Search ..... 345/60–72
See application file for complete search history.

(56) References Cited

U.S. PATENT DOCUMENTS

| | | | | |
|---|---|---|---|---|
| 6,331,843 | B1 | 12/2001 | Kasahara et al. | |
| 6,388,678 | B1 | 5/2002 | Kasahara et al. | |
| 2001/0006379 | A1* | 7/2001 | Kasahara et al. | 345/60 |
| 2005/0231444 | A1* | 10/2005 | Takeuchi et al. | 345/63 |
| 2006/0082521 | A1* | 4/2006 | Shin et al. | 345/63 |
| 2007/0080898 | A1* | 4/2007 | Han | 345/63 |
| 2007/0103393 | A1 | 5/2007 | Han | |

FOREIGN PATENT DOCUMENTS

| | | | |
|---|---|---|---|
| KR | 10-2000-0070660 | A | 11/2000 |
| KR | 10-2004-0058549 | A | 7/2004 |
| KR | 10-2007-0048886 | A | 5/2007 |

* cited by examiner

*Primary Examiner* — Liliana Cerullo
(74) *Attorney, Agent, or Firm* — Lee & Morse, P.C.

(57) ABSTRACT

A plasma display according to an exemplary embodiment of the present invention applies different driving methods according to a maximum grayscale level of image data input for one field. When the maximum grayscale level of the field is higher than a reference level, an address period for selecting a light emitting cell and a non-light emitting cell from a plurality of discharge cells and a sustain period for sustain-discharging light emitting cells among the plurality of discharge cells are simultaneously driven in a plurality of sequential subfields after a first subfield. When the maximum grayscale level of the field is less than the reference level, the address period and the sustain period are time-separately driven in the plurality of subfields.

8 Claims, 11 Drawing Sheets

| Subfield | SF1 | SF2 | SF3 | SF4 | SF5 | SF6 | SF7 | SF8 | ... | SF14 | SF15 | SF16 |
|---|---|---|---|---|---|---|---|---|---|---|---|---|
| Weight / Grayscale | 1 | 2 | 4 | 8 | 16 | 32 | 64 | 64 | | 64 | 64 | 64 |
| 0 | | | | | | | | | | | | |
| 1 | SW | SE | | | | | | | | | | |
| 3 | SW | 0 | SE | | | | | | | | | |
| 7 | SW | 0 | 0 | SE | | | | | | | | |
| 15 | SW | 0 | 0 | 0 | SE | | | | | | | |
| 31 | SW | 0 | 0 | 0 | 0 | SE | | | | | | |
| 63 | SW | 0 | 0 | 0 | 0 | 0 | SE | | | | | |
| 127 | SW | 0 | 0 | 0 | 0 | 0 | 0 | SE | | | | |
| ⋮ | | | | | | | | | | | | |
| 575 | SW | 0 | 0 | 0 | 0 | 0 | 0 | 0 | | 0 | SE | |
| 639 | SW | 0 | 0 | 0 | 0 | 0 | 0 | 0 | ... | 0 | 0 | SE |
| 703 | SW | 0 | 0 | 0 | 0 | 0 | 0 | 0 | | 0 | 0 | 0 |

| Subfield | SF1 | SF2 | SF3 | SF4 | SF5 | SF6 | SF7 | SF8 | SF9 | SF10 |
|---|---|---|---|---|---|---|---|---|---|---|
| Weight / Grayscale | 1 | 2 | 4 | 8 | 16 | 32 | 64 | 64 | 64 | 64 |
| 0 | | | | | | | | | | |
| 1 | SW | | | | | | | | | |
| 2 | | SW | | | | | | | | |
| 3 | SW | SW | | | | | | | | |
| 4 | | | SW | | | | | | | |
| 5 | SW | | SW | | | | | | | |
| 6 | | SW | SW | | | | | | | |
| 7 | SW | SW | SW | | | | | | | |
| 8 | | | | SW | | | | | | |
| 9 | SW | | | SW | | | | | | |
| 10 | | SW | | SW | | | | | | |
| 11 | SW | SW | | SW | | | | | | |
| 12 | | | SW | SW | | | | | | |
| 13 | SW | | SW | SW | | | | | | |
| 14 | | SW | SW | SW | | | | | | |
| 15 | SW | SW | SW | SW | | | | | | |
| 16 | | | | | SW | | | | | |
| 17 | SW | | | | SW | | | | | |
| ⋮ | ⋮ | ⋮ | ⋮ | ⋮ | ⋮ | ⋮ | ⋮ | ⋮ | ⋮ | ⋮ |
| 309 | SW | | SW | | SW | SW | SW | SW | SW | SW |
| 310 | | SW | SW | | SW | SW | SW | SW | SW | SW |
| 311 | SW | SW | SW | | SW | SW | SW | SW | SW | SW |
| 312 | | | | SW | SW | SW | SW | SW | SW | SW |
| 313 | SW | | | SW | SW | SW | SW | SW | SW | SW |
| 314 | | SW | | SW | SW | SW | SW | SW | SW | SW |
| 315 | SW | SW | | SW | SW | SW | SW | SW | SW | SW |
| 316 | | | SW | SW | SW | SW | SW | SW | SW | SW |
| 317 | SW | | SW | SW | SW | SW | SW | SW | SW | SW |
| 318 | | SW | SW | SW | SW | SW | SW | SW | SW | SW |
| 319 | SW | SW | SW | SW | SW | SW | SW | SW | SW | SW |

FIG. 2

| Row groups | Electrodes | Sub-groups | Electrodes |
|---|---|---|---|
| $G_1$ | $X_1, Y_1$<br>$X_2, Y_2$<br>$X_3, Y_3$<br>⋮<br>$X_{n/2-2}, Y_{n/2-2}$<br>$X_{n/2-1}, Y_{n/2-1}$<br>$X_{n/2}, Y_{n/2}$ | $G_{11}$ | $Y_1$<br>⋮<br>$Y_j$ |
| | | $G_{12}$ | $Y_{j+1}$<br>⋮<br>$Y_{2j}$ |
| | | ⋮ | ⋮ |
| | | $G_{16}$ | $Y_{5j+1}$<br>⋮<br>$Y_{6j}$ (= $Y_{n/2}$) |
| $G_2$ | $X_{n/2+1}, Y_{n/2+1}$<br>$X_{n/2+2}, Y_{n/2+2}$<br>$X_{n/2+3}, Y_{n/2+3}$<br>⋮<br>$X_{n-2}, Y_{n-2}$<br>$X_{n-1}, Y_{n-1}$<br>$X_n, Y_n$ | $G_{21}$ | $Y_{6j+1}$<br>⋮<br>$Y_{7j}$ |
| | | $G_{22}$ | $Y_{7j+1}$<br>⋮<br>$Y_{8j}$ |
| | | ⋮ | ⋮ |
| | | $G_{26}$ | $Y_{11j+1}$<br>⋮<br>$Y_{12j}$ (= $_nY$ ) |

FIG. 6

| Subfield | SF1 | SF2 | SF3 | SF4 | SF5 | SF6 | SF7 | SF8 | ... | SF14 | SF15 | SF16 |
|---|---|---|---|---|---|---|---|---|---|---|---|---|
| Weight / Grayscale | 1 | 2 | 4 | 8 | 16 | 32 | 64 | 64 | | 64 | 64 | 64 |
| 0 | | | | | | | | | | | | |
| 1 | SW | SE | | | | | | | | | | |
| 3 | SW | 0 | SE | | | | | | | | | |
| 7 | SW | 0 | 0 | SE | | | | | | | | |
| 15 | SW | 0 | 0 | 0 | SE | | | | | | | |
| 31 | SW | 0 | 0 | 0 | 0 | SE | | | | | | |
| 63 | SW | 0 | 0 | 0 | 0 | 0 | SE | | | | | |
| 127 | SW | 0 | 0 | 0 | 0 | 0 | 0 | SE | | | | |
| ⋮ | | | | | | | | | | | | |
| 575 | SW | 0 | 0 | 0 | 0 | 0 | 0 | 0 | | 0 | SE | |
| 639 | SW | 0 | 0 | 0 | 0 | 0 | 0 | 0 | ... | 0 | 0 | SE |
| 703 | SW | 0 | 0 | 0 | 0 | 0 | 0 | 0 | | 0 | 0 | 0 |

FIG. 10

| Subfield | SF1 | SF2 | SF3 | SF4 | SF5 | SF6 | SF7 | SF8 | SF9 | SF10 |
|---|---|---|---|---|---|---|---|---|---|---|
| Weight / Grayscale | 1 | 2 | 4 | 8 | 16 | 32 | 64 | 64 | 64 | 64 |
| 0 | | | | | | | | | | |
| 1 | SW | | | | | | | | | |
| 2 | | SW | | | | | | | | |
| 3 | SW | SW | | | | | | | | |
| 4 | | | SW | | | | | | | |
| 5 | SW | | SW | | | | | | | |
| 6 | | SW | SW | | | | | | | |
| 7 | SW | SW | SW | | | | | | | |
| 8 | | | | SW | | | | | | |
| 9 | SW | | | SW | | | | | | |
| 10 | | SW | | SW | | | | | | |
| 11 | SW | SW | | SW | | | | | | |
| 12 | | | SW | SW | | | | | | |
| 13 | SW | | SW | SW | | | | | | |
| 14 | | SW | SW | SW | | | | | | |
| 15 | SW | SW | SW | SW | | | | | | |
| 16 | | | | | SW | | | | | |
| 17 | SW | | | | SW | | | | | |
| ⋮ | ⋮ | ⋮ | ⋮ | ⋮ | ⋮ | ⋮ | ⋮ | ⋮ | ⋮ | ⋮ |
| 309 | SW | | SW | | SW | SW | SW | SW | SW | SW |
| 310 | | SW | SW | | SW | SW | SW | SW | SW | SW |
| 311 | SW | SW | SW | | SW | SW | SW | SW | SW | SW |
| 312 | | | | SW | SW | SW | SW | SW | SW | SW |
| 313 | SW | | | SW | SW | SW | SW | SW | SW | SW |
| 314 | | SW | | SW | SW | SW | SW | SW | SW | SW |
| 315 | SW | SW | | SW | SW | SW | SW | SW | SW | SW |
| 316 | | | SW | SW | SW | SW | SW | SW | SW | SW |
| 317 | SW | | SW | SW | SW | SW | SW | SW | SW | SW |
| 318 | | SW | SW | SW | SW | SW | SW | SW | SW | SW |
| 319 | SW | SW | SW | SW | SW | SW | SW | SW | SW | SW |

PLASMA DISPLAY, CONTROLLER AND DRIVING METHOD THEREOF WITH SIMULTANEOUS DRIVING WHEN MAXIMUM GRAYSCALE IS HIGHER THAN REFERENCE LEVEL

BACKGROUND OF THE INVENTION

1. Field of the Invention

Embodiments relate to a plasma display, a controller therefor, and a driving method thereof.

2. Description of the Related Art

A plasma display panel (PDP) is a flat panel display that uses plasma generated by gas discharge to display characters or images. Depending on its size, the PDP may include more than several scores to millions of pixels arranged in a matrix pattern.

In the plasma display, one field (1 TV field) to be driven may be divided into a plurality of subfields respectively having a weight value. Grayscales may be displayed by combining weight values of subfields in which a display operation is generated. During an address period of each subfield, discharge cells that will emit light and discharge cells that will not emit light are selected by an address discharge. During a sustain period of each subfield, discharge cells to emit light are sustain discharged during a period corresponding to the weight value of a corresponding subfield, thereby displaying an image.

When temporally dividing an address period and a sustain period, an additional address period may be provided to each subfield for addressing all discharge cells in addition to the sustain period for sustain-discharging, thereby increasing the length of a subfield. As a result, a length of a subfield may be increased and a number of subfields that are usable in one field may be limited.

The above information disclosed in this Background section is only for enhancement of understanding of the background of the invention and therefore it may contain information that does not form the prior art that is already known in this country to a person of ordinary skill in the art.

SUMMARY OF THE INVENTION

Embodiments are therefore directed to a plasma display, a controller therefor, and a driving method thereof, which overcome one or more of the problems due to the limitations and disadvantages of the related art.

It is therefore a feature of an embodiment to provide a plasma display for expressing a high grayscale level, a controller therefor, and a driving method thereof.

It is therefore another feature of an embodiment to provide a plasma display providing improved expression of lower grayscale levels, a controller therefor, and a driving method thereof.

At least one of the above and other features and advantages may be realized by providing a driving method of a plasma display including a plurality of row electrodes, a plurality of column electrodes, and a plurality of discharge cells respectively defined by the plurality of row electrode and the plurality of column electrodes, the driving method for driving the plasma display including dividing one field into a plurality of subfields, the driving method including determining a maximum grayscale level of a video signal input for one field, comparing the maximum grayscale level of the video signal to a reference level, and driving the plasma display in accordance with the comparing. When the maximum grayscale level of the video signal is greater than the reference level, driving a plurality of subsequent subfields after a first subfield may include dividing the plurality of row electrodes into first and second row electrode groups, and sustain discharging light emitting cells in a second subgroup of the second row electrode group while selecting a non-light emitting cells from a plurality of light emitting cells in a first subgroup of the first row electrode group. When the maximum grayscale level of the video signal is less than the reference level, driving the plurality of subfields may include selecting the light emitting cell from the plurality of discharge cells, and sustain-discharging the selected light emitting cell.

When the maximum grayscale level of the video signal is greater than the reference level, the method may include sustain discharging light emitting cells in a subgroup of the first row electrode group while selecting non-light emitting cells from the light emitting cells in a subgroup of second row electrode group.

When the maximum grayscale level of the video signal is less than the reference level, the method may include establishing the plurality of discharge cells as non-light emitting cells before selecting light emitting cells.

When the maximum grayscale level of the video signal is greater than the reference level, in a first subfield before the plurality of subsequent subfields, the method may include selecting light emitting cells from discharge cells in the first row electrode group, and sustain-discharging the selected light emitting cell of the first row electrode group, and selecting light emitting cells from the discharge cells in the second row electrode group, and sustain-discharging the selected light emitting cells of the second row electrode group. The method may include, in the first subfield, establishing the plurality of discharge cells as the non-light emitting cells before selecting the light emitting cell from the discharge cells included in the first row electrode group.

A number of subfields that may be realized when using the driving corresponding to when the maximum grayscale level of the video signal may be greater than the reference level is larger than a number of subfields that may be realized when using the driving corresponding to when the maximum grayscale level of the video signal is less than the reference level.

The may be about ⅔ of a maximum grayscale level that may be expressed when using the driving corresponding to when the maximum grayscale level of the video signal is greater than a reference level.

When the maximum grayscale level of the video signal is greater than the reference level, and a desired grayscale level may not be expressed from a combination of subfields, dithering subfields having levels closest to the desired grayscale level.

At least one of the above and other features and advantages may be realized by providing a plasma display, including a plasma display panel (PDP) including a plurality of row electrodes, a plurality of column electrodes crossing the plurality of row electrodes, a plurality of discharge cells defined by the plurality of row electrodes and the plurality of column electrodes, a driver configured to drive the PDP, and a controller configured to determine a maximum grayscale level from a video signal input for one field, to compare the maximum grayscale level of the video signal to a reference level, and to control the driver in accordance with the comparison. When the maximum grayscale level of the video signal is greater than the reference level, for a plurality of subsequent subfields after a first subfield, the driver may be configured to select one of light emitting cells and non-light emitting cells from the plurality of discharge cells, and simultaneously sustain discharge cells among previous light emitting cells. When the maximum grayscale level of the video signal is less than the reference level, the driver may be configured to select light emitting cells from the plurality of discharge cells, and sustain discharge the selected light emitting cells.

When the maximum grayscale level of the video signal is greater than the reference level, the driver may be configured to select light emitting cells in the first subfield and non-light emitting cells in the plurality of subsequent subfields. The driver may be configured to establish the plurality of discharge cells as non-light emitting cells before selecting light emitting cells in a subsequent field.

When the maximum grayscale level of the video signal is greater than the reference level, the driver may be configured, for the plurality of subsequent subfields, to divide the plurality of row electrodes into first and second row electrode groups, divide the first and second row electrode groups into a plurality of first and second subgroups, sustain discharge light emitting cells of a subgroup among the plurality of second subgroups and simultaneously select non-light emitting cells from light emitting cells of a subgroup among the plurality of first subgroups, and sustain discharge light emitting cells of a first subgroup among the plurality of first subgroups and simultaneously select non-light emitting cells from light emitting cells of a subgroup of the second subgroups.

When the maximum grayscale level of the video signal is greater than the reference level, the driver may be configured, for at least one subfield before the plurality of subsequent subfields, to select light emitting cells from the discharge cells of the first row electrode group and sustain discharge the selected light emitting cells of the first row electrode group, and select light emitting cells from the discharge cells of the second row electrode group, and sustain discharge the selected light emitting cell of the second row electrode group.

At least one of the above and other features and advantages may be realized by providing a plasma display, including a plasma display panel (PDP) including a plurality of row electrodes, a plurality of column electrodes crossing the plurality of row electrodes, and a plurality of discharge cells defined by the plurality of row electrodes and the plurality of column electrodes, a driver configured to drive the PDP, and a controller configured to determine a maximum grayscale level from a video signal input for one field, to compare the maximum grayscale level from the video signal with a reference level, and to control the driver according to a result of the comparison. When the maximum grayscale level greater than the reference level, the driver is configured, in a first subfield, to divide the plurality of row electrodes into first and second row electrode groups, divide the first and second row electrode groups into a plurality of first and second subgroups, sequentially address discharge row electrodes in a first subgroup using a first address discharge method to establish light emitting cells in the first subgroup during a first period for respective first subgroups, sustain discharge previously established light emitting cells in second subgroups during a plurality of first periods, sequentially address discharge row electrodes in a second subgroup using the first address discharge method to establish light emitting cells in the second subgroup during a second period for respective second subgroups, and sustain discharge previously established light emitting cells in first subgroups during a plurality of second periods. When the maximum grayscale level less than the reference level, the driver is configured, in each of the plurality of subfields, to sequentially address discharge the plurality of row electrodes using a second address discharge method to establish light emitting cells during a third period, and sustain discharge the established light emitting cells during a fourth period.

Discharge cells in a light emitting state may be established to be in a non-light emitting state by the first address discharge method, and discharge cells in a non-light emitting state may be established to be in the light emitting discharge state by the second address discharge method.

The driver may be configured to establish the plurality of discharge cells as light emitting cells immediately before the earliest first period among the plurality of first periods when using the first address discharge method, and to establish the plurality of discharge cells as non-light emitting cells in the plurality of respective subfields before selecting the light emitting cell when using the second address discharge method.

The respective row electrodes may be defined by first and second electrodes, and the driver is configured to, during the first period for the respective first subgroups, sequentially apply a scan pulse of a first level to the plurality of first electrodes included in the corresponding subgroup and apply an address pulse to the column electrode forming the non-light emitting cell among the light emitting cells defined by the first electrode included in the first subgroup to which the scan pulse is applied, and during the third period, sequentially apply the scan pulse of a second level to the plurality of first electrodes, and apply the address pulse to the column electrode forming the light emitting cell among the non-light emitting cells defined by the plurality of first electrodes to which the scan pulse of the second level is applied.

The respective row electrodes may be defined by first and second electrodes, and the driver may be configured to apply first and second sustain pulses having inverse phases to the first and second electrodes included in at least one second subgroup among the plurality of second subgroups during the first period for the respective first subgroups, and respectively apply the first and second sustain pulses to the plurality of first electrodes and the plurality of second electrodes during the fourth period, and the first and second sustain pulses respectively have a high level voltage and a low level voltage.

One second period among the plurality of second periods may be positioned between the respective first periods among the plurality of first periods.

At least one of the above and other features and advantages may be realized by providing a controller configured to control a driver configured to drive a plasma display panel (PDP) including a plurality of row electrodes, a plurality of column electrodes crossing the plurality of row electrodes, a plurality of discharge cells defined by the plurality of row electrodes and the plurality of column electrodes, the controller being configured to determine a maximum grayscale level of a video signal input for one field, compare the maximum grayscale level of the video signal to a reference level, and control the driver of the PDP in accordance with the comparing. When the maximum grayscale level of the video signal is greater than the reference level, for a plurality of subsequent subfields after a first subfield, the driver is configured to divide the plurality of row electrodes into first and second row electrode groups, and sustain discharge light emitting cells in a subgroup of the second row electrode group and simultaneously address discharge row electrodes in a subgroup of the first row electrode group to establish light emitting cells. When the maximum grayscale level of the video signal is less than the reference level, for the plurality of subfields, the driver is configured to select light emitting cells from the plurality of discharge cells, and sustain discharge the selected light emitting cells.

BRIEF DESCRIPTION OF THE DRAWINGS

The above and other features and advantages will become more apparent to those of ordinary skill in the art by describing in detail exemplary embodiments thereof with reference to the attached drawings, in which:

FIG. 2 illustrates grouping of electrodes respectively applied to a driving method of a plasma display according to a first exemplary embodiment of the present invention;

FIG. 6 illustrates a grayscale expression method according to the driving method of FIG. 3;

FIG. 10 illustrates a grayscale expression method according to the driving method of FIG. 8 driving method.

DETAILED DESCRIPTION OF THE INVENTION

Figure 1:
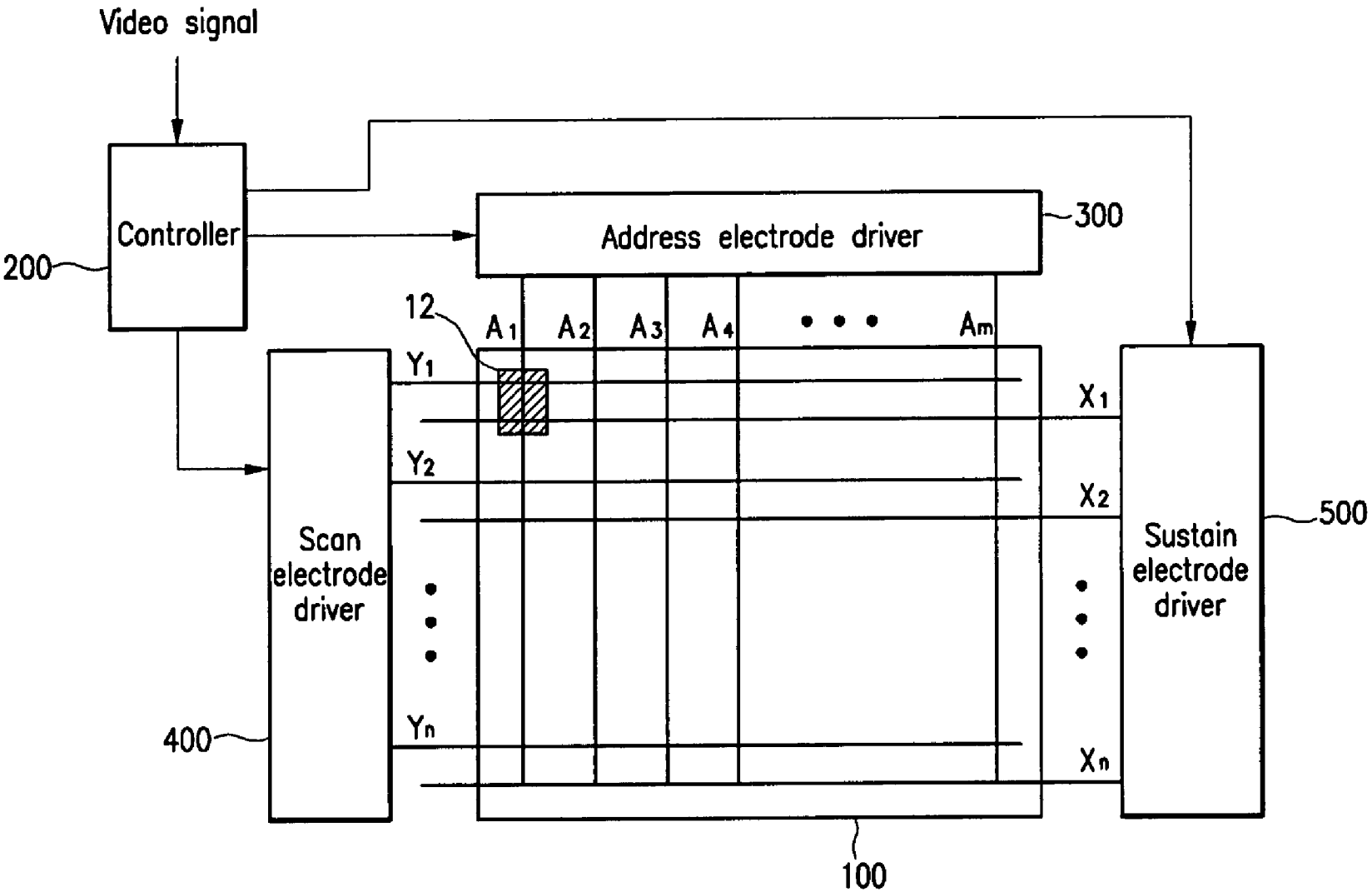
FIG. 1 illustrates a plasma display according to an exemplary embodiment of the present invention.

Korean Patent Application No. 10-2007-0050436, filed on May 23, 2007, in the Korean Intellectual Property Office, and entitled: "Plasma Display and Driving Method Thereof," is incorporated by reference herein in its entirety.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification. In addition, unless explicitly described to the contrary, the word "comprise" and variations such as "comprises" or "comprising" will be understood to imply the inclusion of stated elements but not the exclusion of any other elements.

Wall charges mentioned in the following description mean charges formed and accumulated on a wall (e.g., a dielectric layer) close to an electrode of a discharge cell. A wall charge will be described as being "formed" or "accumulated" on the electrodes, although the wall charges do not actually touch the electrodes. Further, a wall voltage means a potential difference formed on the wall of the discharge cell by the wall charge.

A plasma display according to an exemplary embodiment of the present invention will now be described in further detail with reference to FIG. 1.

FIG. 1 illustrates a plasma display according to an exemplary embodiment of the present invention.

As shown in FIG. 1, the plasma display according to the exemplary embodiment of the present invention may include a plasma display panel (PDP) 100, a controller 200, an address electrode driver 300, a scan electrode driver 400, and a sustain electrode driver 500.

The PDP 100 may include a plurality of address electrodes $A_1$ to $A_m$ extending in a column direction, and a plurality of sustain electrodes $X_1$ to $X_n$ and a plurality of scan electrodes $Y_1$ to $Y_n$ extending in a row direction as pairs. Hereinafter, the address electrode, the sustain electrode, and the scan electrode will be respectively referred to as an A electrode, an X electrode, and a Y electrode. Generally, the X electrodes $X_1$ to $X_n$ may correspond to the Y electrodes $Y_1$ to $Y_n$, and the X electrodes $X_1$ to $X_n$ and the Y electrodes $Y_1$ to $Y_n$ perform a display operation in order to display an image during a sustain period. The Y electrodes $Y_1$ to $Y_n$ and the X electrodes $X_1$ to $X_n$ may perpendicularly cross each other. A discharge space formed at a crossing region of the A electrodes $A_1$ to $A_m$ with the X and Y electrodes $X_1$ to $X_n$ and $Y_1$ to $Y_n$ forms a discharge cell 12. This structure of the PDP 100 is merely exemplary, and panels of other structures may be used in the embodiments as well. Hereinafter, an X electrode and an Y electrode extending in a row direction as a pair will be called row electrodes, and an A electrode extending in a column direction will be called a column electrode.

The controller 200 may externally receive video signals, and may output an A electrode driving control signal, an X electrode control signal, and a Y electrode control signal. In addition, the controller 200 may control the plasma display by dividing a frame into a plurality of subfields, and a plurality of row electrodes into a first group and a second group. The controller 200 may then control the row electrodes of the first and second groups by dividing them respectively into a plurality of sub-groups.

The address electrode driver 300 may receive the A electrode driving control signal from the controller 200, and may apply a display data signal to the A electrodes $A_1$ to $A_m$. The scan electrode driver 400 may receive the Y electrode driving control signal from the controller 200, and may apply a driving voltage to the Y electrodes $Y_1$ to $Y_n$. The sustain electrode driver 500 may receive the X electrode driving control signal from the controller 200, and may apply a driving voltage to the X electrode $X_1$ to $X_n$.

A method for driving the plasma display according to the exemplary embodiment of the present invention will now be described with reference to FIG. 2.

FIG. 2 illustrates grouping of electrodes applied to the driving method of the plasma display according to the exemplary embodiment of the present invention.

As shown in FIG. 2, in one field, a plurality of row electrodes $X_1$ to $X_n$ and $Y_1$ to $Y_n$ are divided into two row groups $G_1$ and $G_2$. A plurality of row electrodes $X_1$ to $X_{n/2}$ and $Y_1$ to $Y_{n/2}$ positioned in a top portion of the PDP 100 may be grouped into a first row group $G_1$ and a plurality of row electrodes $X_1$ to $X_{n/2}$ and $Y_1$ to $Y_{n/2}$ positioned in a bottom portion of the PDP 100 may be grouped into a second group $G_2$. Alternatively, even-numbered row electrodes may be grouped into a first row group $G_1$ and odd-numbered row electrodes may be grouped into a second row group $G_2$. In addition, Y electrodes in the respective first and second row groups $G_1$ and $G_2$ may be divided into a plurality of sub-groups $G_{11}$ to $G_{16}$ and $G_{21}$ to $G_{26}$. For example, as illustrated in FIG. 2, the first and second row groups $G_1$ and $G_2$ may be respectively divided into six sub-groups $G_{11}$ to $G_{16}$ and $G_{21}$ to $G_{26}$.

In particular, in the first row group $G_1$, the first Y electrode $Y_1$ to the j-th Y electrodes $Y_j$ may be grouped into the first sub-group $G_{11}$ and the (j+1)-th Y electrode Y(j+1) to the 2j-th Y electrode $Y_{2j}$ may be grouped into the second sub-group $G_{12}$, and so forth. Thus, the (5j+1)-th Y electrode $Y_{5j+1}$ to the (n/2)-th Y electrode $Y_{n/2}$ may be grouped into the sixth sub-group $G_{16}$ (where j is an integer between 1 and n/16). Similarly, in the second row group $G_2$, the (6j+1)-th Y electrode $Y_{6j+1}$ to the 7j-th Y electrode $Y_{7j}$ may be grouped into the first sub-group $G_{21}$, and the (7j+1)-th Y electrode $Y_{7j+1}$ to the 8j-th Y electrode $Y_{8j}$ may be grouped into the second sub-group $G_{22}$, as so forth. Thus, the (11j+1)-th Y electrode $Y_{11j+1}$ to the n-th Y electrode $Y_n$ may be grouped into the sixth sub-group $G_{26}$. Alternative sub-groupings may be employed, e.g., Y electrodes having a constant distance from each other in the first and second row groups $G_1$ and $G_2$ may be grouped into one sub-group or Y electrodes may be grouped according to an irregular method.

Figure 3:
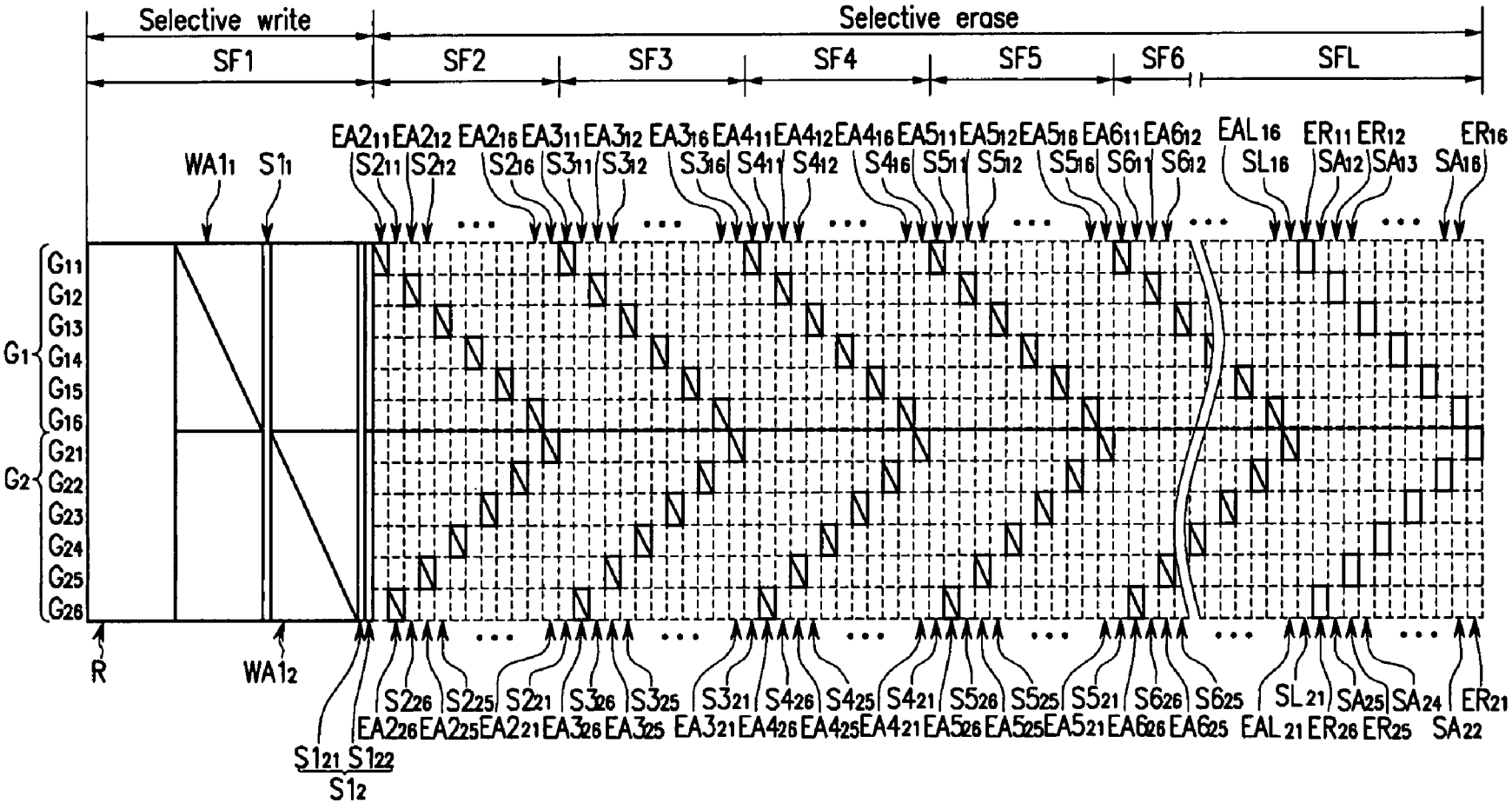
FIG. 3 illustrates a driving method of the plasma display according to a first exemplary embodiment of the present invention.
Figure 4:
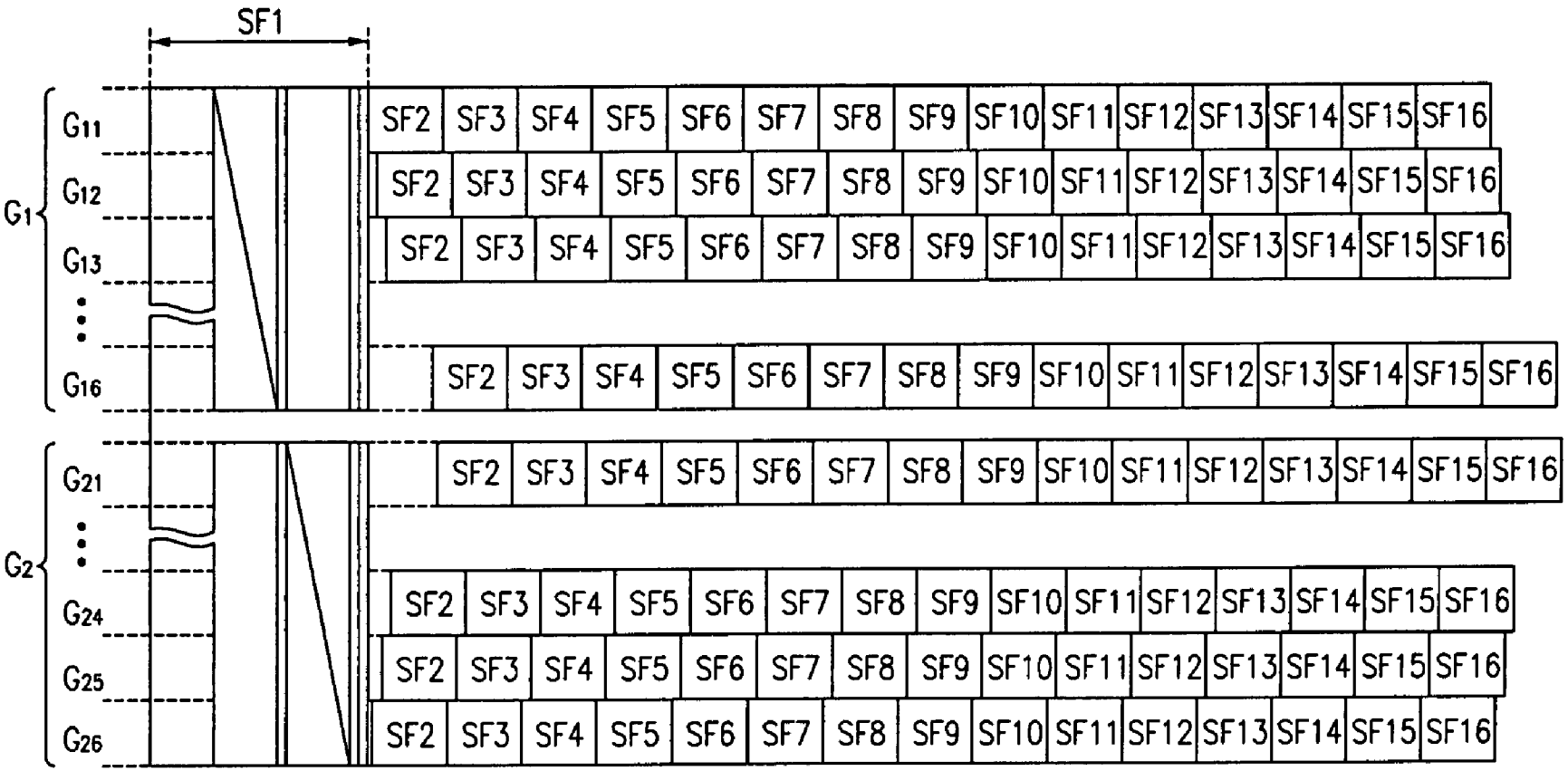
FIG. 4 illustrates the driving method of FIG. 3 applied to subfields.

FIG. 3 illustrates a driving method of the plasma display according to the exemplary embodiment of the present invention, and FIG. 4 illustrates the driving method of FIG. 3 applied to subfields. In FIG. 3, the first and second row groups $G_1$ and $G_2$ are respectively divided into six sub-groups $G_{11}$ to $G_{16}$ and $G_{21}$ to $G_{26}$.

As shown in FIG. 3, one field may be divided into a plurality of subfields SF1 to SFL. The first subfield SF1 may include a reset period R, address periods $WA1_1$ and $WA1_2$, and sustain periods $S1_1$ and $S1_2$. A selective write method may be applied to the address periods $WA1_1$ and $WA1_2$. The second to L-th subfields SF2 to SFL may respectively include address periods $EA2_{11}$ to $EAL_{16}$ and $EA2_{21}$ to $EAL_{26}$, and sustain periods $S2_{11}$ to $SL_{16}$ and $S2_{21}$ to $SL_{26}$. A selective erase address method may be applied to the address periods $EA2_{11}$ to $EAL_{16}$ and $EA2_{21}$ to $EAL_{26}$ of the second to L-th subfields SF2 to SFL. In addition, a plurality of row electrodes $X_1$ to $X_n$ and $Y_1$ to $Y_n$ may be respectively grouped into first and second row groups $G_1$ and $G_2$, and the first and second row groups $G_1$ and $G_2$ may be respectively grouped into plurality of sub-groups $G_{11}$ to $G_{16}$ and $G_{21}$ to $G_{26}$.

Methods for selecting discharge cells to emit light (hereinafter referred to as light emitting cells) and discharge cells to emit no light (hereinafter referred to as non-light-emitting cells) from among a plurality of discharge cells include a selective write method and a selective erase method. The selective write method selects a light emitting cell and generates a constant wall voltage. In other words, in the selective write method, cells in the non-light-emitting state are address discharged and thus, wall charges are formed such that the non-light-emitting state is switched to the light emitting state. The selective erase method selects a non-light-emitting cell and erases the wall voltage. In other words, in the selective erase method, cells in the light emitting state are address discharged and thus, wall charges that had already been formed are erased such that the light emitting state is switched to the non-light-emitting state according to the selective erase method. The address discharge that forms the wall charge in the selective write method is called a "write discharge", and the address discharge that erases the wall charge in the selective erase method is called an "erase discharge".

Referring to FIG. 3, in the first subfield SF1 having the address periods $WA1_1$ and $WA1_2$ employing the selective write method, the reset period R may be provided before the address periods $WA1_1$ and $WA1_2$ so as to initialize all discharge cells in the light emitting state to the non-light emitting state. That is, discharge cells of the first and second row groups $G_1$ and $G_2$ are initialized to the non-light emitting state in the reset period R of the first subfield SF1, and are write discharged in the address periods $WA1_1$ and $WA1_2$.

Discharge cells set to be light emitting cells among the discharge cells of the first row group $G_1$ are write-discharged to form wall charges in the address period $WA1_1$, and discharge cells of the first row groups $G_1$ are sustain discharged in the sustain period $S1_1$. In this case, a minimum number (e.g., one or two) of sustain discharges is set to be generated in the sustain period $S1_1$. Discharge cells set to be light emitting cells among discharge cells of the second row group $G_2$ are write-discharged to form wall charges in the address period $WA1_2$, and the discharge cells of the first and second row groups $G_1$ and $G_2$ are sustain discharged in a partial period $S1_{21}$ of the sustain period $S1_2$. In addition, only the discharge cells of the second row group $G_2$ are sustain discharged while the discharge cells of the first row group $G_1$ are not sustain discharged during the other partial period $S1_{22}$ of the sustain period $S1_2$. In this case, the number of sustain discharges generated in the discharge cells of the second row group $G_2$ during the partial period $S1_{22}$ of the sustain period $S1_2$ is set to correspond to the number of sustain discharges generated in the discharge cells of the first row group $G_1$.

When a weight of the first subfield SF1 is not satisfied by the sustain periods $S1_1$ and $S1_2$, discharge cells of the first and second row groups $G_1$ and $G_2$ may be additionally sustain discharged during the partial period $S1_{22}$ of the sustain period $S1_2$.

In the second subfield SF2, the address periods $EA2_{11}$ to $EA2_{16}$ may be sequentially applied from the first sub-group $G_{11}$ to the eighth sub-group $G_{12}$ of the first row group $G_1$, and the address periods $EA2_{26}$ to $EA2_{21}$ may be sequentially applied from the sixth sub-group $G2_{26}$ to the first sub-group $G_{21}$ of the second row group $G_2$. The address periods $EA3_{11}$ to $EAL_{16}$ and $EA3_{21}$ to $EAL_{26}$ and the sustain periods $S3_{11}$ to $SL_{16}$ and $S3_{21}$ to $SL_{26}$ may be sequentially performed from the third subfield to the L-th subfield as in the second subfield. Since address and sustain operations during the address periods $EA2_{11}$ to $EAL_{16}$ and $EA2_{21}$ to $EAL_{26}$ and the sustain periods $S2_{11}$ to $SL_{16}$ and $S2_{21}$ to $SL_{26}$ are substantially the same in the subfields SF2 to SFL, only address operations of address periods $EAk_{11}$ to $EAk_{16}$ and $EAk_{21}$ to $EAk_{26}$ and sustain operations of sustain periods $Sk_{11}$ to $Sk_{16}$ and $Sk_{21}$ to $Sk_{26}$ of the k-th subfield SFk (where k is an integer between 2 and L) will be described hereinafter.

In particular, in the k-th subfield SFk of the first row group $G_1$, the sustain period $Sk_{1i}$ of the i-th sub-group $G_{1i}$ may be performed after the address period $EAk_{1i}$ of the i-th sub-group $G_{1i}$ is performed (where i is an integer between 1 and 6). Subsequently, the address period $EAk_{1(i+1)}$ and the sustain period $Sk_{1(i+1)}$ of the (i+1)-th sub-group $G_{1(i+1)}$ may be performed. In the k-th subfield SFk of the second row group $G_2$, the sustain period $Sk_{2(i+1)}$ of the (i+1) sub-group $G_{2(i+1)}$ may be performed after the address period $EAk_{2(i+1)}$ of the (i+1) sub-group $G_{2(i+1)}$ is performed. Subsequently, the address period $EAk_{2i}$ and the sustain period $Sk_{2i}$ of the i-th sub-group $G_{2i}$ are performed. In this case, in the k-th subfield SFk, the address period $EAk_{2(6-(i-1))}$ of the (6−(i−1))-th sub-group $G_{2(6-(i-1))}$ of the second row group $G_2$ may be performed while the sustain period $Sk_{1i}$ of the i-th sub-group $G_{1i}$ of the first row group $G_1$ is performed. In addition, in the k-th subfield SFk, the address period $EAk_{1(i+1)}$ of the (i+1)-th sub-group $G_{1(i+1)}$ may be performed in the first row group $G_1$ while the sustain period $Sk_{2(6-(i-1))}$ of the second row group $G_2$ is performed.

Although FIG. 3 illustrates that the address periods $EAk_{26}$ to $EAk_{21}$ and the sustain periods $Sk_{26}$ to $Sk_{21}$ are sequentially applied from the sixth sub-group $G_{26}$ to the first sub-group $G_{21}$ of the second row group $G_2$, the address periods $EAk_{26}$ to $EAk_{21}$ and the sustain periods $Sk_{26}$ to $Sk_{21}$ may be sequentially applied from the first sub-group $G_{21}$ to the sixth sub-group $G_{26}$, as in the first row group $G_1$. Alternatively, the address periods and the sustain periods may be applied in a different order in the first and second row groups $G_1$ and $G_2$.

The respective subfields SF2 to SFL of the first row group $G_1$ will now be described in further detail. Discharge cells to be set as non-light emitting cells among discharge cells of the first sub-group $G_{11}$ of the k-th subfield SFk in the first row group $G_1$ may be erase-discharged during the address period $EAk_{11}$ of the first sub-group $G_{11}$ so as to erase the wall charges, and other discharge cells of the first sub-group $G_{11}$ may be sustain discharged during the sustain period $Sk_{11}$. Discharge cells to be set as non-light emitting cells among discharge cells of the second sub-group $G_{12}$ may be erase-discharged so as to erase the wall charges during the address period $EAk_{12}$ of the second sub-group $G_{12}$, and other discharge cells of the second sub-group $G_{12}$ may be sustain discharged during the sustain period $Sk_{12}$. At this time, the light emitting cells of the first sub-group $G_{11}$ may be sustain discharged. The address periods $EAk_{13}$ to $EAk_{16}$ and the sustain periods $Sk_{13}$ to $Sk_{16}$ may be respectively applied to other sub-groups $G_{13}$ to $G_{16}$ as in the manner described above.

In this case, the light emitting cells of the i-th sub-group $G_{1i}$, the first to (i−1)-th sub-groups $G_{11}$ to $G_{1(i-1)}$, and the (i+1)-th to sixth sub-groups $G_{1(i+1)}$ to $G_{16}$ may be sustain discharged during the sustain period $Sk_{1i}$ of the i-th sub-group $G_{1i}$. Herein, the light emitting cells of the first to (i−1)-th sub-groups $G_{11}$ to $G_{1(i-1)}$ correspond to the discharge cells that have not experienced an erase discharge during the respective address periods $EAk_{11}$-$EAk_{1(i-1)}$ of the k-th subfield SFk, and the light emitting cells of the (i+1)-th to sixth sub-groups $G_{1(i+1)}$ to $G_{16}$ correspond to the light emitting cells that have not experienced the erase discharge during the respective address periods $EA(k-1)_{1(i+1)}$ to $EA(k-1)_{16}$ of the (k−1)-th subfield SF(k−1). The light emitting cells of the i-th sub-group $G_{1i}$ may be sustain discharged until the address period $EA(k+1)_{1i}$ of the i-th sub-group $G_{1i}$ of the (k+1)-th subfield SF(k+1). That is, the light emitting cells of the i-th sub-group $G_{1i}$ may be sustain discharged during six sustain periods.

Accordingly, the address periods $EA\mathbf{2}_{11}$ to $EA\mathbf{2}_{16}$, . . . , $EAL_{11}$ to $EAL_{16}$ and the sustain periods $S\mathbf{2}_{11}$ to $S\mathbf{2}_{16}$, . . . , $SL_{11}$ to $SL_{16}$ may be applied to the respective sub-groups $G_{11}$ to $G_{16}$ of the respective subfields SF2 to SFL. In this way, the discharge cells set to be in a light emitting state during the sustain periods $S\mathbf{1}_{11}$ to $S\mathbf{1}_{16}$ of the first subfield SF1 may be sustain discharged until the discharge cells are erase-discharged in the respective subfields SF2 to SFL and thus, the discharge cells in the light emitting state are switched to the non-light emitting state. After the discharge cells in the light emitting state are switched to the non-light emitting state due to the erase-discharge, no sustain discharge is generated from the corresponding subfield. In this case, a weight of each of the subfields SF2 to SFL corresponds to a sum of the lengths of sixth sustain periods of the respective subfields.

When the sustain period $SL_{16}$ of the subfield SFL is performed, the first sub-group $G_{11}$ experiences six sustain discharges, the second sub-group $G_{12}$ experiences five sustain discharges, and the third sub-group $G_{13}$ experiences four sustain discharges. In addition, the fourth sub-group $G_{14}$ experiences three sustain discharges, the fifth sub-group $G_{15}$ experiences two sustain discharges, and the sixth sub-group $G_{16}$ experiences one sustain discharge. Accordingly, the first to sixth sub-groups $G_{11}$ to $G_{16}$ may experience the same number of sustain discharges. For this purpose, the last subfield SFL of the first row group $G_1$ may include erase periods $ER_{11}$ to $ER_{15}$ and additional sustain periods $SA_{12}$ to $SA_{16}$.

Since the first sub-group $G_{11}$ has been sustain discharged six times immediately before a subsequent erase period $ER_{11}$, the first sub-group $G_{11}$ may not need to experience an additional sustain discharge. Therefore, wall charges formed in the light emitting cells of the first sub-group $G_{11}$ may be erased during the erase period $ER_{11}$. Then, the light emitting cells of the second to sixth sub-groups $G_{12}$-$G_{16}$ may emit light during the additional sustain period $SA_{12}$. Since the wall charges formed in the light emitting cells of the first sub-group $G_{11}$ are erased during the erase period $ER_{11}$, the additional sustain discharge is generated once in the light emitting cells of the second to sixth sub-groups $G_{12}$ to $G_{16}$ during the additional sustain period $SA_{12}$.

Since the second sub-group $G_{12}$ has been sustain discharged six times due to the additional sustain period $SA_{12}$, the second sub-group $G_{12}$ may not need to experience an additional sustain discharge. Therefore, wall charges formed in the light emitting cells of the second sub-group $G_{12}$ may be erased during the erase period $ER_{12}$. Then, the light emitting cells of the third to sixth sub-groups $G_{13}$-$G_{16}$ may emit light during the addition sustain period $SA_{13}$. In this case, since the wall charges formed in the light emitting cells of the first and second sub-groups $G_{11}$ and $G_{12}$ are erased during the respective erase periods $ER_{11}$ and $ER_{12}$, the additional sustain discharge is performed once in the light emitting cells of the third to sixth sub-groups $G_{13}$-$G_{16}$ during the additional sustain period $SA_{13}$.

Subsequently, wall charges formed in the light emitting cells of the third sub-group $G_{13}$ may be erased during the erase period $ER_{13}$, since the third sub-group $G_{13}$ has been sustain discharged six times due to the additional sustain period $SA_{13}$ and does not need to experience an additional sustain discharge. Then, the light emitting cells of the fourth to sixth sub-groups $G_{14}$-$G_{16}$ may emit light during the additional sustain period $SA_{14}$. In this case, since the wall charges formed in the light emitting cells of the first to third sub-groups $G_{11}$-$G_{13}$ are erased during the respective erase periods $ER_{11}$-$ER_{13}$, the additional sustain discharge is generated once in the light emitting cells of the fourth to sixth sub-groups $G_{14}$-$G_{16}$ respectively during the additional sustain period $SA_{14}$.

Accordingly, the same number of sustain discharge may be respectively generated in the first to sixth sub-groups $G_{11}$-$G_{16}$ by performing the erase periods $ER_{14}$ to $ER_{15}$ and the additional sustain periods $SA_{15}$ to $SA_{16}$.

An erase period $ER_{16}$ may be additionally performed for erasing wall charges formed in the sixth sub-group $G_{11}$ after the additional sustain period $SA_{16}$ of the sixth sub-group $G_{16}$. However, the erase period $ER_{16}$ may not be performed, since the reset period R is applied in the first subfield SF1 of the next field. The erase operation of the respective erase periods $ER_{11}$ to $ER_{16}$ may be sequentially performed for each row electrode of the respective sub-groups, or may be simultaneously performed for all row electrodes of the respective row groups.

Respective subfields SF2 to SFL of the second row group $G_2$ may be the same as those of the first row group $G_1$ in structure. However, address periods $EA\mathbf{2}_{26}$ to $EA\mathbf{2}_{21}$, . . . , $EAL_{26}$ to $EAL_{21}$ may be sequentially applied from the sixth sub-group $G_{26}$ to the first sub-group $G_{21}$ in the respective subfields SF1 to SFL of the second row group $G_2$, and erase periods $ER_{26}$ to $ER_{25}$ may be applied from the sixth sub-group $G_{26}$ to the first sub-group $G_{21}$ in the last subfield SFL of the second row group $G_2$.

A driving method of such a plasma display may be described with reference only to subfields as shown in FIG. 4. That is, each of the sub-groups $G_{11}$-$G_{16}$ and $G_{26}$-$G_{21}$ may have a plurality of subfields SF2 to SF16, shifted by a predetermined time from each other. As illustrated in FIG. 4, one field may be divided into 16 subfields SF1 to SF16. In this case, the predetermined time may correspond to a sum of an address period $EAk_{1i}$ or $EAk_{2i}$ of one sub-group $G_{1i}$ or $G_{2i}$ and a sustain period $Sk_{1i}$ or $Sk_{2i}$ of one sub-group $G_{1i}$ or $G_{2i}$. If the length of the address period $EAk_{1i}$ or $EAk_{2i}$ of the sub-group $G_{1i}$ or $G_{2i}$ corresponds to the length of the sustain period $Sk_{1i}$ or $Sk_{2i}$ of the sub-group $G_{1i}$ or $G_{2i}$, a start point of the respective subfields SF2 to SF16 of the second row group $G_2$ is shifted by a time between a start point of the respective subfields SF2 to SF16 of the first row group $G_1$ and the address period $EAk_{1i}$ or $EAk_{2i}$.

A driving waveform of the plasma display using the driving method of FIG. 3 will now be described in further detail with reference to FIG. 5A and FIG. 5B.

Figure 5A:
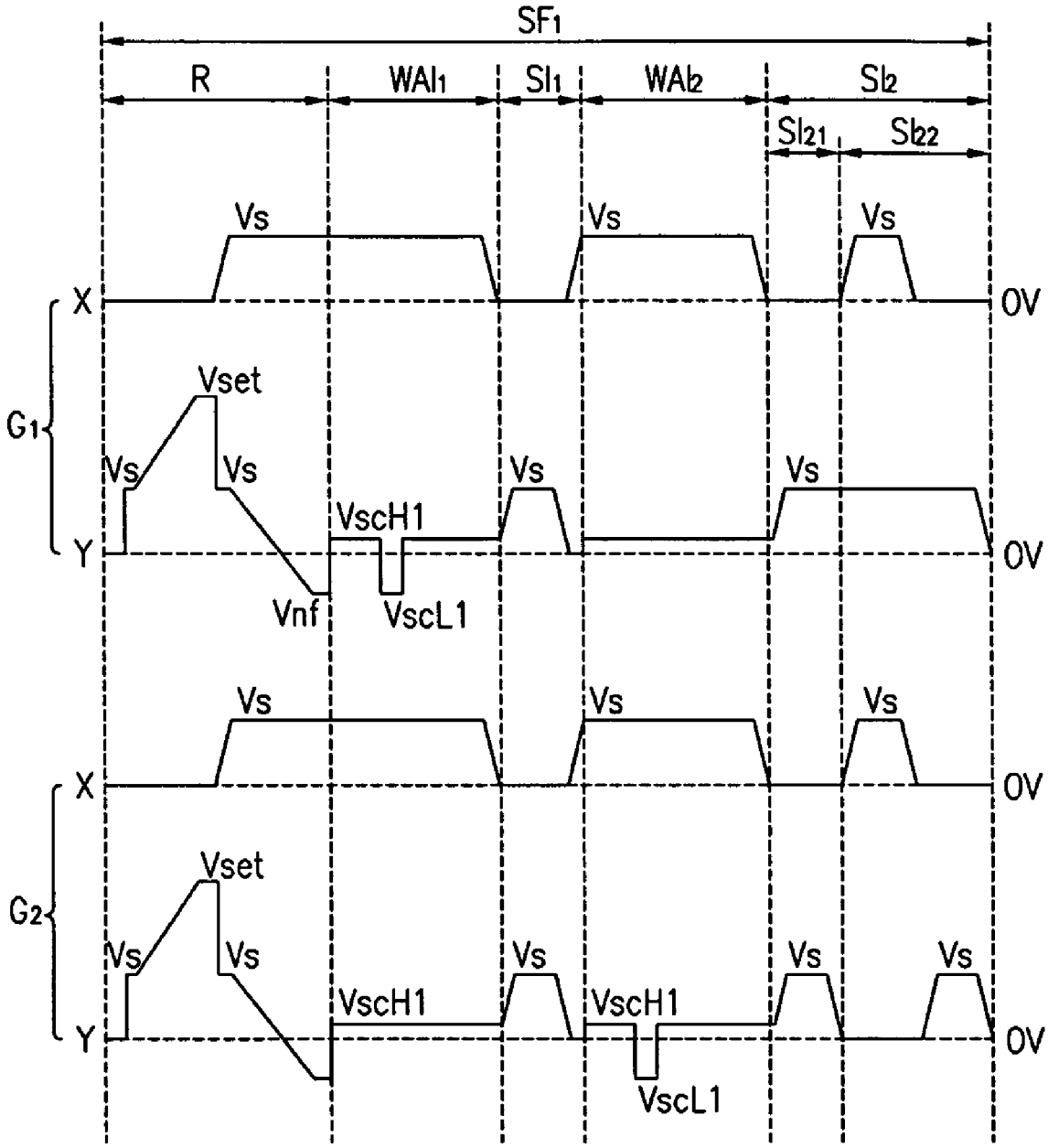
FIG. 5A illustrates a driving waveform of the first subfield SF1 of FIG. 3.

FIG. 5A illustrates a driving waveform of the first subfield SF1 of FIG. 3 in accordance with an embodiment.

As shown in FIG. 5A, during a reset period R, a voltage of the plurality of Y electrodes of the first and second row groups $G_1$ and $G_2$ may be gradually increased from a voltage Vs to a voltage Vset and a reference voltage (0V voltage in FIG. 5A) may be applied to the plurality of X electrodes of the first and second row groups $G_1$ and $G_2$. A weak reset discharge may be generated between the Y electrodes and the X electrodes while the voltage of the Y electrodes increases, so that wall charges are formed in the discharge cells of the first and second row groups $G_1$ and $G_2$. Subsequently, the voltage of the plurality of Y electrodes of the first and second row groups $G_1$ and $G_2$ may be gradually decreased from the voltage Vs to a voltage Vnf and the voltage Vs may be applied to the plurality of X electrodes of the first and second row groups $G_1$ and $G_2$. A weak reset discharge may be generated between the Y electrodes and the X electrodes while the voltage of the Y electrodes decreases, so that the wall charges formed in the discharge cells of the first and second row groups $G_1$ and $G_2$ are erased and the discharge cells are initialized to a non-light emitting state. In general, a voltage (Vnf−Vs) may be set close to a discharge firing voltage between the Y electrode and the X electrode. Thus, since a wall voltage between the Y electrode and the X electrode may approach the reference voltage, a misfire may be prevented during a sustain period in a cell in which no write discharge is generated during the address period.

During the address period $WA1_1$, a scan pulse having a voltage VscL1 may be sequentially applied to the plurality of Y electrodes of the first group $G_1$, an address pulse having a positive voltage may be applied to an A electrode for selecting light emitting cells, and the voltage Vs may be applied to the plurality of X electrodes of the first and second row groups $G_1$ and $G_2$. Then, a write discharge may be is generated in a discharge cell to which the scan pulse of the VscL1 voltage and the address pulse of the positive voltage are applied. Thus, a wall voltage is formed in the X and Y electrodes, so that the discharge cells are switched to a light emitting cell. A voltage VscH1 that is higher than the voltage VscL1 may be applied to Y electrodes to which the scan pulse is not applied, and the reference voltage may be applied to A electrodes to which the address pulse is not applied.

In further detail, the scan pulse may be applied to a Y electrode $Y_1$ of the first row of the first row group $G_1$, and, at the same time, the address pulse may be applied to an A electrode of a light emitting cell of the first row. Then, a write discharge may be generated between the Y electrode of the first row and the A electrode applied with the address pulse, so that positive (+) wall charges are formed on the Y electrode and negative (−) wall charges are formed on the A and X electrodes. Subsequently, the scan pulse may be applied to a Y electrode $Y_2$ of the second row and, at the same time, the address pulse may be applied to an A electrode of a light emitting cell of the second row. Then, a write discharge is generated between the A electrode applied with the address pulse and the Y electrode of the second row so that wall charges are formed on the respective electrodes Y, A, and X.

In a like manner, the wall charges may be formed on the respective Y, A, and X electrodes by applying the address pulse to the A electrode of a light emitting cell while sequentially applying the scan pulse to the remaining Y electrodes.

During the sustain period $S1_1$, the voltage Vs may be applied to the plurality of Y electrodes of the first and second row groups $G_1$ and $G_2$, and the reference voltage may be applied to the plurality of X electrodes of the first and second row groups $G_1$ and $G_2$, so as to sustain discharge the light emitting cells. Since a cell that has experienced the write discharge during the address period $WA1_1$ may be switched to a light emitting cell, only a cell that has experienced the write discharge during the address period $WA1_1$ experiences the sustain discharge. As a result of the sustain discharge, negative (−) wall charges are formed on the Y electrodes and positive (+) wall charges are formed on the X electrodes of the first row group $G_1$. In FIG. 5A, the sustain discharge is generated once during the sustain period $S1_1$.

In the address period $WA1_2$, the scan pulse of the voltage VscL may be sequentially applied to the Y electrodes of the second row group $G_2$ and the address pulse of the positive voltage may be applied to the A electrode, so as to write discharge cells in the non-light emitting state for selecting light emitting cells, while the voltage Vs is applied to the plurality of X electrodes of the first and second row groups $G_1$ and $G_2$, and the voltage VscH is applied to the Y electrodes of the first row group $G_1$. Since the voltage VscH1 is low, a sustain discharge is generated in the light emitting cells of the first row group $G_1$ by the voltage Vs applied to the X electrodes of the first row group $G_1$ and the wall charges formed on the Y and X electrodes of the first row group $G_1$. As a result of the sustain discharge, positive (+) wall charges are formed on the Y electrodes of the first row group $G_1$ and negative (−) wall charges are formed on the X electrodes of the first row group $G_1$.

Subsequently, in a first period $S1_{21}$ of the sustain period $S1_2$, the voltage Vs may be applied to the plurality of Y electrodes of the first and second row groups $G_1$ and $G_2$, and the reference voltage may be applied to the plurality of X electrodes of the first and second row groups $G_1$ and $G_2$ to sustain discharge the light emitting cells of the first and second row groups $G_1$ and $G_2$. In a second period $S1_{22}$ of the sustain period $S1_2$, the voltage Vs may be applied to the plurality of Y electrodes of the first row group $G_1$ and the reference voltage may be applied to the plurality of Y electrodes of the second row group $G_2$, while the voltage Vs is applied to the plurality of X electrodes of the first and second row groups $G_1$ and $G_2$, so as to sustain discharge only the light emitting cells of the second row group $G_2$. Then, in the second period $S1_{22}$, the voltage Vs may be applied to the plurality of Y electrodes of the second row group $G_2$ and the reference voltage may be applied to the plurality of X electrodes of the second row group $G_2$, so as to additionally sustain discharge the light emitting cells of the second row group $G_2$. Since the light emitting cells of the first row group $G_1$ have not experienced the sustain discharge in the first period $S1_{21}$, they do not experience the sustain discharge in the second period $S1_{22}$. The number of sustain discharges generated in the light emitting cells of the second row group $G_2$ during the second period $S1_{22}$ may correspond to the number of sustain discharges generated in the light emitting cells of the first row group $G_1$ during the periods $S1_1$ and $WA1_2$. In addition, when a weight of the first subfield SF1 is not satisfied by the sustain periods $S1_1$ and $S1_2$, an additional sustain period may be applied to simultaneously sustain discharge the light emitting cells of the first and second row groups $G_1$ and $G_2$.

Figure 5B:
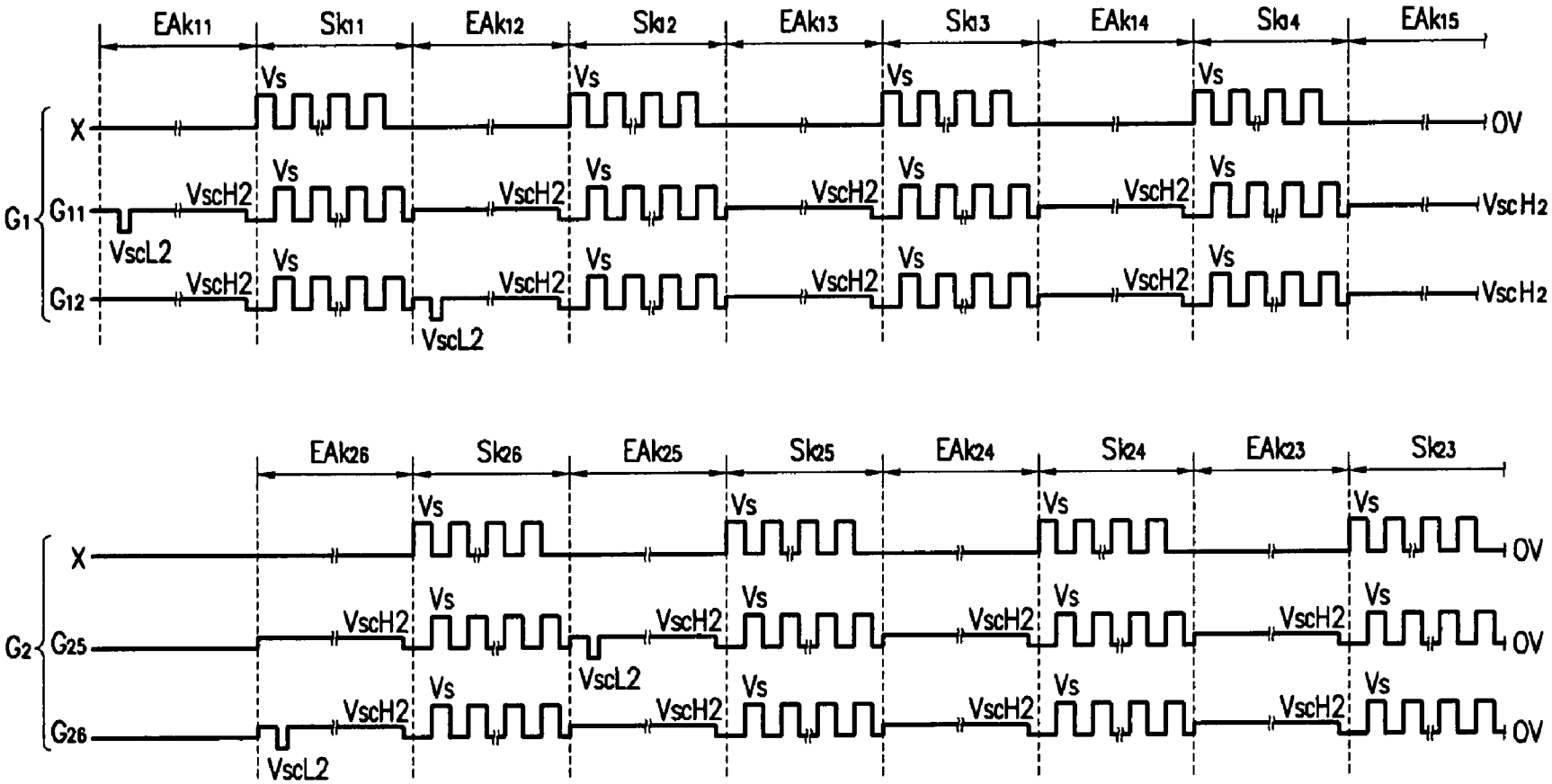
FIG. 5B illustrates a driving waveform of the k-th subfield (SFk) for use with the second subfield SF2 to the L-th subfield SFL of FIG. 3.

FIG. 5B shows a driving waveform of the k-th subfield SFk among the second to L-th subfields SF2 to SFL of FIG. 3. For better understanding and ease of description, FIG. 5B illustrates first and second sub-groups $G_{11}$ and $G_{12}$ of the first row group $G_1$ and fifth and sixth sub-groups $G_{25}$ and $G_{26}$ of the second row group $G_2$ of one subfield SFk among the second to L-th subfields SF2 to SFL.

As shown in FIG. 5B, in an address period $EAk_{11}$ of the first sub-group $G_{11}$ of the first row group $G_1$, a scan pulse having a voltage VscL2 may be applied to a plurality of Y electrodes of the first sub-group $G_{11}$, and the reference voltage (0V voltage in FIG. 5B) may be applied to an X electrode of the first row group $G_1$. In this case, an address pulse (not shown) having a positive voltage may be applied to an A electrode of a cell to be selected as a non-light emitting cell among light emitting cells formed by the Y electrodes to which the scan pulse is applied. In addition, voltage VscH2 that is higher than the voltage VScL2 may be applied to a Y electrode to which the scan pulse is not applied among the Y electrodes of the first row group $G_1$ and a plurality of Y electrodes of the second row group $G_2$, and the reference voltage may be applied to an A electrode to which the address pulse is not applied. Then, an erase discharge is generated in a light emitting cell to which the scan pulse of the voltage VscL2 and the address pulse of the positive voltage are applied. Thus, the light emitting cell may be switched to a non-light emitting cell.

Although FIG. 5B illustrates that the scan pulse is applied to one Y electrode during the address period $EAk_{11}$ for better understanding and ease of description, the scan electrode driver 400 may sequentially select Y electrodes to be applied with the scan pulse among the plurality of Y electrodes of the first sub-group $G_{11}$. For example, vertically arranged Y electrodes may be sequentially selected in a single driving mode. When one of the Y electrodes is selected, the address electrode driver 300 may select turn-on discharge cells among discharge cells formed by the selected Y electrode. That is, the address electrode driver 300 may select a discharge cell to which an address pulse having the voltage Va among the A electrodes A1 to Am is applied.

In a sustain period $Sk_{11}$ of the first sub-group $G_{11}$, a sustain discharge pulse alternately having a high level voltage (voltage Vs in FIG. 5B) and a low level voltage (0V voltage in FIG. 5B) may be applied to the plurality of X electrodes and a plurality of Y electrodes of the first row group $G_1$, so as to sustain discharge the light emitting cells of the first sub-group $G_{11}$. Herein, the sustain discharge pulse applied to the X electrodes has a reverse phase of the sustain discharge pulse applied to the Y electrodes. That is, when the high level voltage is applied to the X electrodes, the low level voltage is applied to the Y electrodes, and when the high level voltage is applied to the Y electrodes, the low level voltage is applied to the X electrodes. Discharge cells that have not experienced an erase discharge during the address period $EAk_{11}$ among discharge cells in the light emitting state in the previous subfield SF(k−1) remain in the light emitting state and experience a sustain discharge.

An address period $EAk_{26}$ of the sixth sub-group $G_{26}$ may be performed while the sustain period $Sk_{11}$ of the first sub-group $G_{11}$ is performed. In the address period $EAk_{26}$, the scan pulse having the voltage VscL2 may be applied to a plurality of Y electrodes of the second sub-group $G_{12}$ while the reference voltage is applied to an X electrode of the second row group $G_2$, and an address pulse (not shown) having a positive voltage may be applied to an A electrode of a discharge cell to be selected as a non-light emitting cell among light emitting cells formed by the Y electrodes to which the scan pulse is applied. The voltage VscH2 may be applied to Y electrodes to which the scan pulse is not applied among the Y electrodes of the second row group $G_2$ and the Y electrodes of the first row group $G_1$, and the reference voltage may be applied to A electrodes to which the address pulse is not applied. Then, an erase discharge is generated in the light emitting cell to which the scan pulse having the voltage VscL2 and the address pulse having the positive voltage may be applied, so that the wall charges formed on the X and Y electrodes are erased, and the light emitting cell is switched to a non-light emitting cell.

Subsequently, a sustain period $Sk_{26}$ of the sixth sub-group $G_{26}$ of the second row group $G_2$ may be performed. In the sustain period $Sk_{26}$, a sustain pulse is applied to the plurality of X and Y electrodes of the second row group $G_2$ and thus, a sustain discharge is generated in the corresponding light emitting cells. Herein, the sustain pulse applied to the X electrodes has an opposite phase to that of the sustain pulse applied to the Y electrodes.

The address period $EAk_{12}$ of the second sub-group $G_{12}$ of the first row group $G_1$ is performed while the sustain period $Sk_{26}$ is performed. In the address period $EAk_{12}$, the scan pulse having the voltage VscL2 may be applied to the Y electrodes of the second sub-group $G_{12}$ and the reference voltage may be applied to the X electrode of the first row group $G_1$. The address pulse having the voltage Va may be applied to an A electrode of a light emitting cell to be switched to the non-light emitting state among light emitting cells formed by the Y electrodes to which the scan pulse having the voltage VscL2 is applied. In addition, Y electrodes of the first row group $G_1$, to which no sustain pulse has been applied, may be applied with the voltage VscH2, and the reference voltage may be applied to A electrodes to which the address pulse is not applied. Then, an erase discharge is generated in the light emitting cell to which the scan pulse having the VscL2 and the address pulse having the voltage Va are applied. Thus, the wall charges formed on the X and Y electrodes are erased and the light emitting cells are switched to the non-light emitting state.

Address periods $EAk_{13}$ to $EAk_{16}$ and sustain periods $Sk_{12}$ to $Sk_{16}$ of the other sub-groups $G_{12}$ to $G_{16}$ of the first row group $G_1$, and address periods $EAk_{25}$ to $EAk_{21}$ and sustain periods $Sk_{25}$ to $Sk_{21}$ of the other sub-groups $G_{25}$ to $G_{21}$ of the second row group $G_2$ may be performed in a like manner.

Accordingly, the sustain period may be applied to the row electrodes of the second row group $G_2$ while the address period is applied to the row electrodes of the first row group $G_1$, and the sustain period may be applied to the row electrodes of the first row group $G_1$ while the address period is applied to the row electrodes of the second row group $G_2$. In other words, the sustain period may be performed while the address period is performed, rather than dividing the address period and the sustain period. Accordingly, the length of one subfield may be reduced. In addition, since the address period is provided between the respective sustain periods of each sub-group, priming particles formed during the sustain periods may be effectively utilized during the address period. Accordingly, a high-speed scanning process with a short scan pulse may be performed. Therefore, the number of subfields that may be used for one frame is increased, thereby increasing the maximum grayscale level that can be expressed.

A method for expressing a grayscale by using the driving method of FIG. 3 will be described in further detail with reference to FIG. 6.

FIG. 6 illustrates a grayscale expression method according to a first exemplary embodiment of the present invention. In FIG. 6, one field includes sixteen subfields. When a write discharge is generated in the corresponding subfield and thus, a non-light emitting cell is switched to the light emitting state, that subfield is denoted by "SW". When an erase discharge is generated in the corresponding subfield and thus, a light emitting cell is switched to the non-light emitting state, that subfield is denoted by "SE". When a discharge cell is in the light emitting state, that subfield is denoted by "○".

As shown in FIG. 6, weights of the first to sixteenth subfields SF1 to SF16 may be respectively set to 1, 2, 4, 8, 16, 32, 32, 64, . . . , and 64. That is, the weights of the first to sixth subfields SF1 to SF6 may be respectively set to 1, 2, 4, 8, 16, and 32, and the weights of the seventh to sixteenth subfields SF7 to SF16 may all be set to 64. When no write discharge is generated during an address period of the first subfield SF1 among the subfields SF1 to SF16 having such weights, no sustain discharge is generated in the first subfield SF1 and the next subfields SF2 to SF16. Accordingly, a grayscale of 0 is expressed. When the write discharge is generated in the address period of the first subfield SF1 and thus, a discharge cell of the first subfield is switched to the light emitting state, a sustain discharge is generated in the second subfield SF2. Accordingly a grayscale of 1 may be expressed. When an erase discharge is generated in an address period of the second subfield SF2 and thus, a discharge cell of the second subfield SF2 is switched to the non-light emitting state, no sustain discharge is generated from the second subfield SF2 to the sixteenth subfield SF16. Accordingly, the grayscale of 1 may be expressed. In addition, when the erase discharge is not generated in the address period of the second subfield SF2, but is generated in an address period of the third subfield SF3, the light emitting cell is switched to the non-light emitting state. Accordingly, a grayscale of 3 may be expressed.

In general, when an erase discharge is generated in the k-th subfield and thus the light emitting cell is switched to the non-light emitting state, a discharge cell in the light emitting state continuously experiences a sustain discharge from the first to (k−1)-th subfields. Accordingly, a grayscale that corresponds to a sum of weights of the first to (k−1)-th subfields may be expressed. A grayscale that cannot be expressed by a sum of the weights of the respective subfields may be expressed by using dithering. Such dithering is a technology for approximately and on average expressing the grayscale to be expressed in a predetermined area by combining predetermined grayscales. For example, grayscales between a grayscale of 31 and a grayscale of 63 can be expressed by dithering the grayscales 31 and 63 in a predetermined pixel area.

As described, the grayscales may be expressed by the consecutive subfields SF2 to SF16 until discharge cells in the light emitting state are erase-discharged in the corresponding subfield, i.e., they are switched to the non-light emitting state. Therefore, occurrence of contour noise may be reduced or eliminated according to the first exemplary embodiment of the present invention. In addition, the discharge cells that are switched to the light emitting state in the first subfield SF1 may be continuously sustain discharged until they are erase-discharged, i.e., switched to the non-light emitting state. Therefore, any grayscale may be expressed by performing a sustain discharge twice at most. Accordingly, power consumption can be reduced.

However, since the human eye recognizes a grayscale difference better between low grayscales than between high grayscales, expression of low grayscales may be degraded when the low grayscales are expressed by using the dithering method rather than using a combination of grayscales of subfields. Hereinafter, an exemplary embodiment for increasing the maximum grayscale level while improving expression of low grayscales will be described in further detail with reference to FIG. 7.

Figure 7:
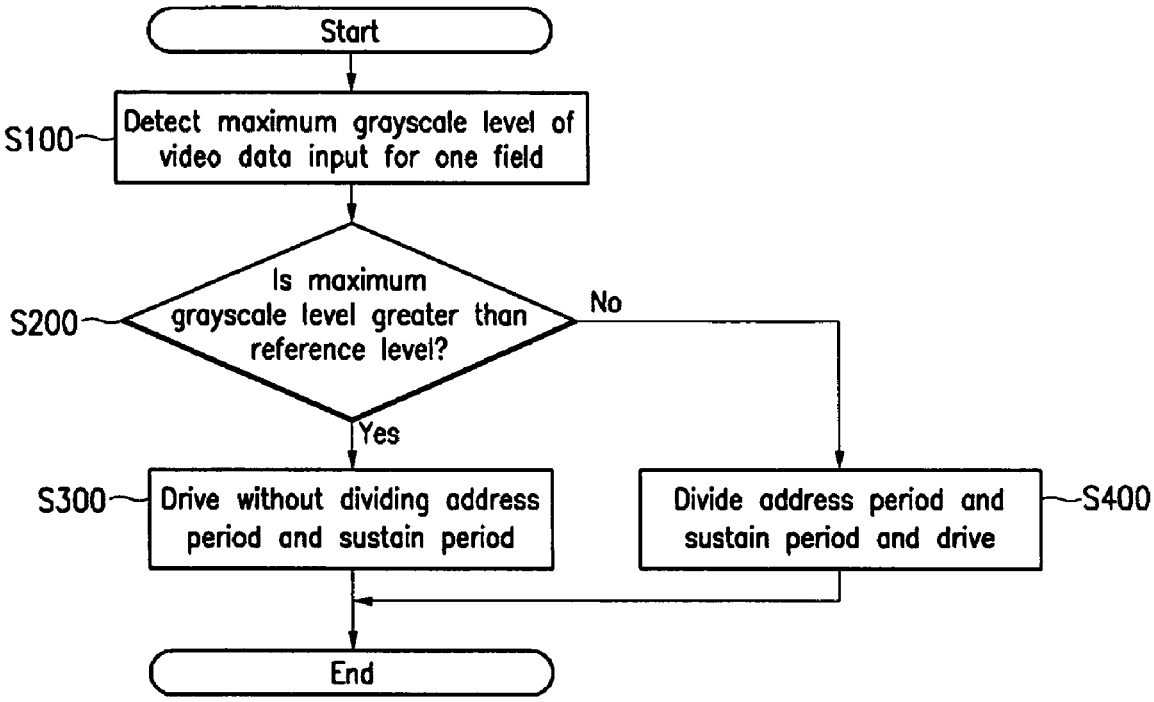
FIG. 7 illustrates a flowchart of a controller according to the exemplary embodiment of the present invention.

FIG. 7 illustrates a flowchart of the controller 200 according to an exemplary embodiment of the present invention.

As shown in FIG. 7, the controller 200 may detect the maximum grayscale level of video signals input during one field in operation S100, and may compare the detected maximum grayscale level with a reference level in operation S200. When the detected maximum grayscale level is higher than the reference level, the controller 200 may output control signals to the respective drivers 300, 400, and 500 for driving the plasma display without dividing an address period and a sustain period, e.g., using the driving method shown in FIG. 3, in operation S300. When the detected maximum grayscale level is less than the reference level, the controller 200 may output control signals to the respective drivers 300, 400, and 500 for driving the plasma display by dividing the address period and the sustain period, in operation S400. For example, the reference level may be set to about ⅔ of the maximum grayscale level that can be expressed by the driving method of FIG. 3. When the maximum grayscale level equals the reference level, the controller 200 may use either driving method noted above. For example, in an implementation, when the maximum grayscale level is equal to the reference level, the plasma display may be driven by dividing the address period and the sustain period. Alternatively, when the maximum grayscale level is equal to the reference level, the plasma display may be driven without dividing the address period and the sustain period.

For example, when the number of row electrodes is 768 and a total number of sustain pulses in one frame is 1200, the reset period may be 0.5 ms, one scan pulse may be applied in 1.1 μs, and one sustain pulse may be applied in 0.6 μs. Since one frame time is 16.67 ms (=1/60 sec), approximately 10 (=(16.67 ms−0.5 ms−(6.0 μs×1200))/(1.1 μs×768)) subfields may be used during one frame when the plasma display is driven by dividing the address period and the sustain period. When the plasma display is driven without dividing the address period and the sustain period, the length of one subfield becomes 936 μs (=156×6), assuming that one group time is 156 μs. Therefore, approximately 17 (=(16.67 ms−(1.1 μs×768×1+6.0 μs))/936 μs) subfields may be used during one frame. However, since one subfield is required for performing a sustain discharge to the last sub-group, approximately 16 subfields may be substantially used during one frame.

When the number of row electrodes increases (e.g., the number of row electrodes is 1080), the address period increases when the address period and the sustain period are divided. Therefore, time allocated to each sustain period is reduced. For example, the time allocated to the address period becomes 11.9 ms (=1.1 μs×1080×10) in one frame. Therefore, a sustain discharge may be performed approximately 700 times for one frame. However, when the plasma display is driven without dividing the address period and the sustain period, the sustain discharge can be performed 1200 times for one frame. Thus, for this particular example, the maximum grayscale level that may be realized using the driving method for driving the plasma display in which the address period and the sustain period are divided is about ⅔ of the maximum grayscale level that may be realized using the driving method for driving the plasma display in which the address period and the sustain period are not divided.

When the maximum grayscale level to be expressed within one frame is less than a reference level, e.g., ⅔ of the maximum grayscale level that may be expressed by using the driving method in which the address period and the sustain period are not divided, e.g., as shown in FIG. 3, the controller 200 may use the driving method that divides the address period and the sustain period, to thereby improve grayscale expression ability and prevent excessive electromagnetic interference. When the maximum grayscale level to be expressed within one frame is greater than the reference level, e.g., ⅔ of the maximum grayscale level that can be expressed by using the driving method in which the address period and the sustain period are not divided, the controller 200 may use the driving method for driving the plasma display without dividing the address period and the sustain period.

The driving method that divides the address period and the sustain period in a temporal manner will now be described in further detail with reference to FIG. 8 to FIG. 10.

Figure 8:
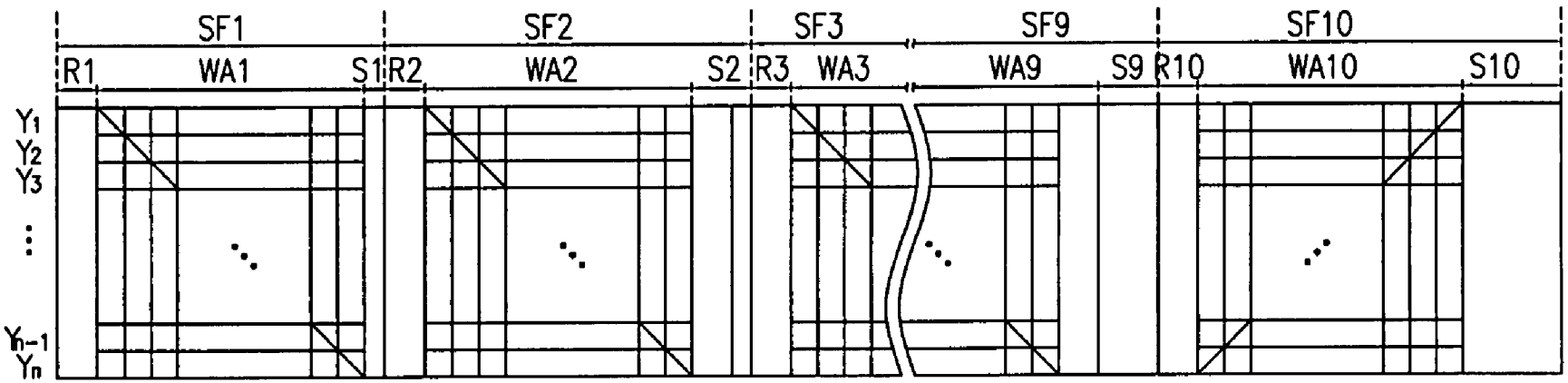
FIG. 8 illustrates a method for driving a plasma display by diving an address period and a sustain period in a temporal manner according to another exemplary embodiment of the present invention.

FIG. 8 illustrates a diagram representing a driving method for driving the plasma display by dividing the address period and the sustain period according to the exemplary embodiment of the present invention.

As shown in FIG. 8, in the plurality of subfields SF1 to SF10 of one field, a selective write method for selecting the light emitting cell and the non-light emitting cell may be used. In further detail, the subfields SF1 to SF10 may respectively include reset periods R1 to R10, address periods WA1 to WA10, and sustain periods S1 to S10. The discharge cells may be initialized in the respective reset periods R1 to R10 to be established in a non-light emitting cell state. Discharge cells to be established in a light emitting cell state from the non-light emitting cell state may be write-discharged to form wall charges in the respective address periods WA1 to WA10. Finally, the light emitting cells selected in the corresponding address periods WA1 to WA10 may be sustain discharged in the sustain periods S1 to S10.

Figure 9:
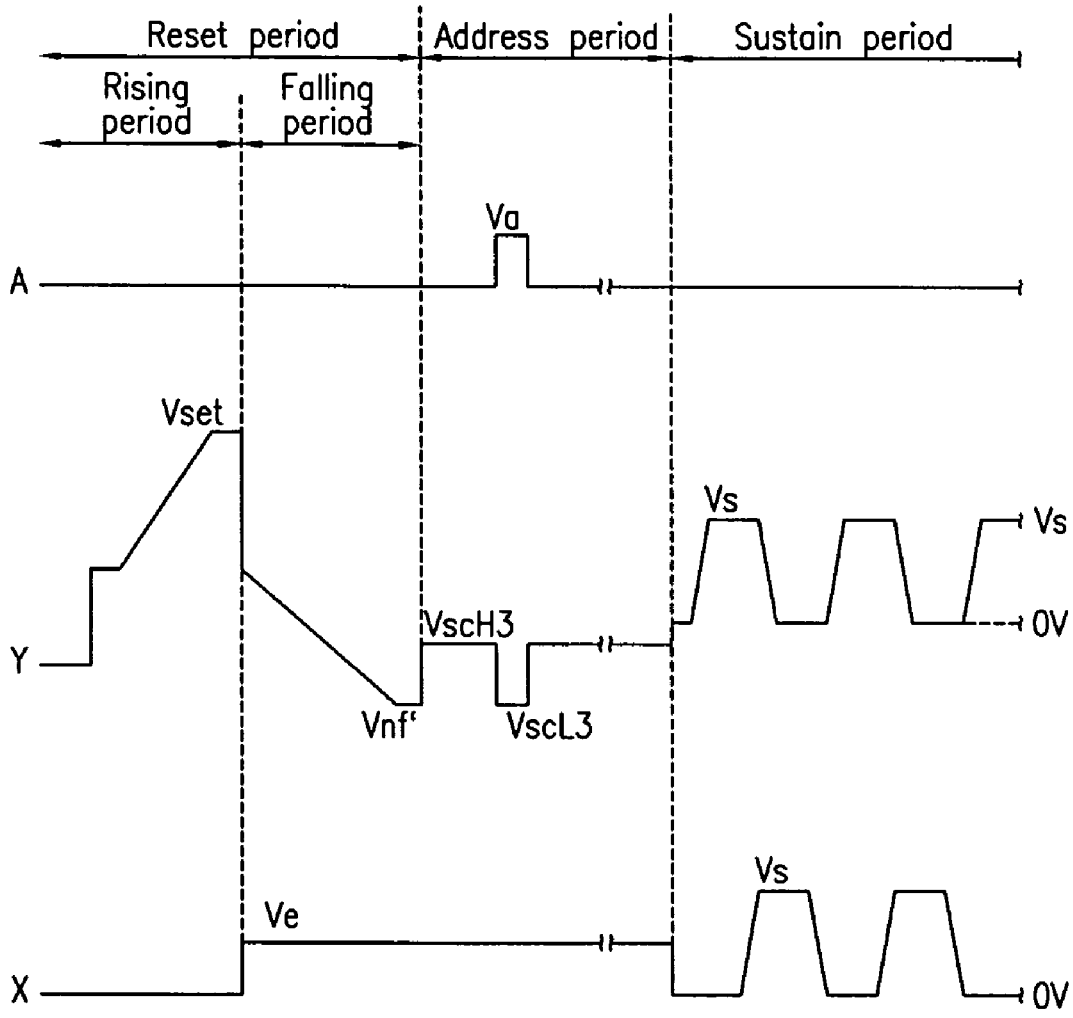
FIG. 9 illustrates a driving waveform of a plasma display to which the driving method of FIG. 8 is applied.

FIG. 9 illustrates a diagram representing driving waveforms of the plasma display driven in the driving method shown in FIG. 8. In FIG. 9, for better understanding and ease of description, one subfield among the plurality of subfields is illustrated, and one X electrode, one Y electrode, and one A electrode are illustrated.

As shown in FIG. 9, during a rising period of the reset period, while the X electrode is maintained at the reference voltage (the 0V voltage in FIG. 9), the voltage of the Y electrode may gradually increase, e.g., in a ramp waveform, from the Vs voltage to the Vset voltage. Thereby, a weak discharge may be generated between the Y and X electrodes, and between the Y and A electrodes while the voltage of the Y electrode increases. Thus, (−) wall charges are formed on the Y electrode, and (+) wall charges are formed on the X and A electrodes.

During a falling period of the reset period, while the X electrode is maintained at a Ve voltage, the voltage of the Y electrode may gradually decrease, e.g., in a ramp waveform, from the Vs voltage to a Vnf voltage. Thereby, a weak discharge may be generated between the Y and X electrodes and the Y, and A electrodes while the voltage of the Y electrode decreases. Thus, the (−) wall charges formed on the Y electrode and the (+) wall charges formed on the X and A electrodes are eliminated. In general, a voltage of (Vnf−Ve) may be close to a discharge firing voltage between the Y electrode and the X electrode. Thereby, a wall voltage between the Y and X electrodes approaches the 0V voltage, and the cell having no address discharge during the address period does not misfire during the sustain period.

During the address period, while the voltage of the X electrode is maintained at the Ve voltage, a scan pulse having a VscL3 voltage and an address pulse having the Va voltage may be respectively applied to the Y electrode and the A electrode to select the light emitting cell. A VscH3 voltage that is higher than the VscL3 voltage is applied to the Y electrode to which the VscL3 voltage is not applied, and the reference voltage is applied to the A electrode of the non-light emitting cell. A value of |VscL3−VscH3| may be the same as a value of |VscL1−VscH1| in FIG. 5A, and a value of |VscL3−Ve| may be the same as a value of |VscL1−Vs| in FIG. 5A.

During the sustain period, the sustain pulse alternately having the Vs voltage and the reference voltage is applied to the Y electrode and the X electrode. The sustain pulse applied to the Y electrode may have an opposite phase of the sustain pulse applied to the X electrode. In other words, the reference voltage is applied to the X electrode when the Vs voltage is applied to the Y electrode, and the reference voltage is applied to the Y electrode when the Vs voltage is applied to the X electrode. Subsequently, an operation for applying the sustain pulse of the Vs voltage to the Y electrode and an operation for applying the sustain pulse of the Vs voltage to the X electrode are repeatedly performed a number of times corresponding to a weight value of the corresponding subfield.

In addition, the respective subfields SF1 to SF10 may use the driving waveform shown in FIG. 5A, or may use other driving waveforms in accordance with the selective write method.

FIG. 10 illustrates a diagram representing a grayscale expression method in the driving method shown in FIG. 8.

As shown in FIG. 10, 0 to 319 grayscales may be continuously expressed by combinations of turned-on subfields among the plurality of subfields SF1 to SF10. Since the respective subfields SF1 to SF10 include reset periods R1 to R10 for establishing all the discharge cells to be in the non-light emitting cell state, the cell of the light emitting cell state in a previous subfield may be established to be in the non-light emitting cell state. Accordingly, since grayscales may be expressed by combinations of the turned-on subfields among the plurality of subfields SF1 to SF10, performance of expressing low grayscales may be improved compared to the driving method shown in FIG. 3.

As described above, according to the exemplary embodiment of the present invention, since different driving methods are respectively applied according to the maximum grayscale level of the video signal input for one field, the performance of expressing low grayscales may be improved, while still allowing higher grayscales to be expressed.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A driving method of a plasma display including a plurality of row electrodes, a plurality of column electrodes, and a plurality of discharge cells respectively defined by the plurality of row electrodes and the plurality of column electrodes, the driving method for driving the plasma display including dividing a field into a plurality of subfields, the driving method comprising:

determining a maximum grayscale level of a video signal input for the field;

comparing the maximum grayscale level of the video signal to a reference level; and driving the plasma display in accordance with the comparing, wherein, when the maximum grayscale level of the video signal is greater than the reference level, driving a plurality of subsequent subfields after a first subfield of the plurality of subfields includes:

dividing the plurality of row electrodes into first and second row electrode groups, and sustain-discharging light emitting cells in a second subgroup of the second row electrode group while selecting non-light emitting cells from a plurality of light emitting cells in a first subgroup of the first row electrode group; and when the maximum grayscale level of the video signal is less than the reference level, driving the plurality of subfields includes, for each of the plurality of subfields:

selecting light emitting cells from the plurality of discharge cells, and sustain discharging the selected light emitting cells.

2. The driving method as claimed in claim 1, further comprising, when the maximum grayscale level of the video signal is greater than the reference level, sustain discharging light emitting cells in a subgroup of the first row electrode group while selecting non-light emitting cells from the light emitting cells in a subgroup of the second row electrode group.

3. The driving method as claimed in claim 2, further comprising, when the maximum grayscale level of the video signal is less than or equal to the reference level, establishing the plurality of discharge cells as non-light emitting cells before selecting light emitting cells.

4. The driving method as claimed in claim 1, further comprising, when the maximum grayscale level of the video signal is greater than the reference level, in a first subfield before the plurality of subsequent subfields:

selecting light emitting cells from discharge cells in the first row electrode group, and sustain-discharging the selected light emitting cells of the first row electrode group; and selecting light emitting cells from the discharge cells in the second row electrode group, and sustain-discharging the selected light emitting cells of the second row electrode group.

5. The driving method as claimed in claim 4, further comprising, in the first subfield, establishing the plurality of discharge cells as the non-light emitting cells before selecting the light emitting cell from the discharge cells included in the first row electrode group.

6. The driving method as claimed in claim 1, wherein a number of subfields that may be realized when using the driving corresponding to when the maximum grayscale level of the video signal is greater than the reference level is larger than a number of subfields that may be realized when using the driving corresponding to when the maximum grayscale level of the video signal is less than or equal to the reference level.

7. The driving method as claimed in claim 1, wherein the reference level is ⅔ of a maximum grayscale level that may be expressed when using the driving corresponding to when the maximum grayscale level of the video signal is greater than the reference level.

8. The driving method as claimed in claim 1, further comprising, when the maximum grayscale level of the video signal is greater than the reference level, and a desired grayscale level cannot be expressed from a combination of subfields, dithering subfields having levels closest to the desired grayscale level.

* * * * *